US007873290B2

(12) United States Patent
Sheflin et al.

(10) Patent No.: US 7,873,290 B2
(45) Date of Patent: Jan. 18, 2011

(54) DYNAMIC PROCESS CONTROL FOR IMAGE PRINTING DEVICES IN THE PRESENCE OF RELOAD DEFECTS BASED ON CUSTOMER IMAGE CONTENT

(75) Inventors: Joseph C. Sheflin, Macedon, NY (US); Jack T. Lestrange, Macedon, NY (US); Peter Paul, Webster, NY (US); Aaron M. Burry, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 296 days.

(21) Appl. No.: 12/250,658

(22) Filed: Oct. 14, 2008

(65) Prior Publication Data

US 2010/0092191 A1 Apr. 15, 2010

(51) Int. Cl.
*G03G 15/00* (2006.01)

(52) U.S. Cl. ..... 399/49

(58) Field of Classification Search ..... 399/15, 399/49, 60, 72; 347/19
See application file for complete search history.

(56) References Cited

U.S. PATENT DOCUMENTS

| | | | | |
|---|---|---|---|---|
| 4,338,880 | A | 7/1982 | Tabuchi et al. | |
| 5,060,013 | A * | 10/1991 | Spence | 399/72 |
| 5,652,946 | A | 7/1997 | Scheuer et al. | |
| 5,826,139 | A * | 10/1998 | Nacman et al. | 399/72 |
| 6,016,204 | A | 1/2000 | Budnik et al. | |
| 6,697,582 | B1 | 2/2004 | Scheuer | |
| 6,816,687 | B1 * | 11/2004 | Dalal et al. | 399/49 |
| 6,842,590 | B2 * | 1/2005 | Dalal et al. | 399/49 |
| 6,904,255 | B2 | 6/2005 | Kera et al. | |
| 6,915,087 | B2 * | 7/2005 | Furno et al. | 399/49 |
| 6,970,660 | B2 * | 11/2005 | Harada et al. | 399/49 |
| 7,013,094 | B2 * | 3/2006 | Dalal et al. | 399/49 |
| 7,024,152 | B2 | 4/2006 | Lofthus et al. | |
| 7,136,616 | B2 | 11/2006 | Mandel et al. | |
| 7,177,585 | B2 | 2/2007 | Matsuzaka et al. | |
| 7,228,083 | B2 * | 6/2007 | Iwakawa | 399/49 |
| 7,266,317 | B2 * | 9/2007 | Okano | 399/49 |
| 7,272,333 | B2 | 9/2007 | Mizes | |
| 7,418,216 | B2 * | 8/2008 | Elliot et al. | 399/49 |
| 7,542,172 | B2 * | 6/2009 | Klassen | 358/3.26 |
| 7,542,688 | B2 * | 6/2009 | Klassen | 399/28 |
| 2003/0235418 | A1 * | 12/2003 | Furno et al. | 399/49 |
| 2006/0109487 | A1 | 5/2006 | Klassen | |
| 2010/0014877 | A1 * | 1/2010 | Sheflin et al. | 399/49 |

FOREIGN PATENT DOCUMENTS

| | | | |
|---|---|---|---|
| JP | 63108364 A | * | 5/1988 |
| JP | 10104892 A | * | 4/1998 |

* cited by examiner

*Primary Examiner*—Robert Beatty
(74) *Attorney, Agent, or Firm*—Pillsbury Winthrop Shaw Pittman LLP

(57) ABSTRACT

A method and system for controlling an image printing system in the presence of reload defects are provided. The method comprises placing toner images on an image bearing surface moving in a process direction, determining the density of the toner image or a portion thereof being printed on the image bearing surface, and printing a scheduled control patch at a location in the cross-process direction on the image bearing surface, wherein the location where each control patch is printed is dynamically changed based on the density of the toner image adjacent the control patch or a portion thereof.

22 Claims, 14 Drawing Sheets

DYNAMIC PROCESS CONTROL FOR IMAGE PRINTING DEVICES IN THE PRESENCE OF RELOAD DEFECTS BASED ON CUSTOMER IMAGE CONTENT

BACKGROUND

1. Field

The present disclosure relates to a method and a system for controlling an image printing system in the presence of reload defects.

2. Description of Related Art

Xerographic and electrophotographic printing and marking engines schedule control patches for calibration and other machine diagnostic procedures. The control patches are printed between images in what is called "inter-document zones" (IDZ) on the photoreceptor belt and/or other image bearing surface using a calibration procedure having a desired toner area coverage, for example, as disclosed in U.S. Pat. No. 6,016,204, which is incorporated by reference herein in its entirety. The areas of the image bearing surface where toner images of the print job are printed, by contrast, are called the "customer image zones," or "image zones."

The control patches may include one or more toner density patches. The toner area coverage, AC is defined as the percentage of toner area covering a unit halftone cell in a sample target that is available to reflect. As known in the art, control patches may be varied uniformly for each test patch from 0 to 100%. These control patches are sensed and machine parameters may be adjusted to maintain a tone reproduction curve (TRC).

As the marking engine's performance degrades over time, different image quality (IQ) problems may arise. In particular, one IQ problem of concern is reload. Reload defects may occur when the reload performance of the toner development system degrades to the point where the toner image impacts the control patches, and/or, the control patches impacts the toner image with a reload or ghosting defect.

FIG. 1 illustrates a known toner development system 100 in an image printing system. Such a system is disclosed, for example, in U.S. Patent Application Publication No. 2006/0109487, which is incorporated by reference herein in its entirety.

The toner development system 100 includes a reservoir 164 containing developer material 166. The developer material 166 may be either of the one component or two component type; that is, it comprises carrier granules and toner particles. The reservoir 164 includes augers 168, which are rotatably-mounted in the reservoir chamber. The augers 168 serve to transport and to agitate the material within the reservoir 164 and encourage the toner particles to charge and adhere triboelectrically to the carrier granules. In one embodiment, a magnetic brush roll 170 transports developer material 166 from the reservoir to loading nips 172 and 174 of donor rolls 176 and 178. Magnetic brush rolls are well known, so the construction of roll 170 is not described in great detail. Briefly, the roll 170 includes a rotatable tubular housing within which is located a stationary magnetic cylinder having a plurality of magnetic poles impressed around its surface. The carrier granules of the developer material 166 are magnetic and, as the tubular housing of the roll 170 rotates, the granules (with toner particles adhering triboelectrically thereto) are attracted to the roll 170 and are conveyed to the donor roll loading nips 172 and 174. A metering blade 180 removes excess developer material from the magnetic brush roll 170 and ensures an even depth of coverage with developer material 166 before arrival at the first donor roll loading nip 172.

At each of the donor roll loading nips 172 and 174, toner particles are transferred from the magnetic brush roll 170 to the respective donor roll 176 and 178. The carrier granules and any toner particles that remain on the magnetic brush roll 170 are returned to the reservoir 164 as the magnetic brush continues to rotate. Transfer of toner from the magnetic brush roll 170 to the donor rolls 176 and 178 can be encouraged by, for example, the application of a suitable D.C. electrical bias to the magnetic brush and/or donor rolls. The D.C. bias (for example, approximately 70 V applied to the magnetic roll) establishes an electrostatic field between the donor rolls 176 and 178 and magnetic brush roll 170 that causes toner particles to be attracted to the donor roll from the carrier granules on the magnetic roll. The relative amounts of toner transferred from the magnetic roll 170 to the donor rolls 176 and 178 can be adjusted, for example, by applying different bias voltages to the donor rolls; by adjusting the magnetic to donor roll spacing; by adjusting the strength and shape of the magnetic field at the loading nips; and/or by adjusting the speeds of the donor rolls.

Each donor roll 176 or 178 transports the toner to a respective development zone 182 and 184 through which the image bearing surface 10 passes. At each of the development zones 182 and 184, toner is transferred from the respective donor roll 176 and 178 to the latent image on the image bearing surface 10 to form a toner image on the latter. Various methods of achieving an adequate transfer of toner from a donor roll to a latent image on an image bearing surface are known and any of those may be employed at the development zones 182 and 184.

In the toner development system 100 of FIG. 1, each of the development zones 182 and 184 is shown as having a pair of electrode wires 86 and 88 disposed in the space between each donor roll 176 and 178 and image bearing surface 10. The electrode wires may be made from thin (for example, 50 to 100 micron diameter) stainless steel wires closely spaced from the respective donor roll. The wires are self-spaced from the donor rolls by the thickness of the toner on the donor rolls and may be within the range from about 5 micron to about 20 micron (typically about 10 micron) or the thickness of the toner layer on the donor roll.

For each of the donor rolls 176 and 178, the respective electrode wires 86 and 88 extend in a direction substantially parallel to the longitudinal axis of the donor roll. An alternating electrical bias is applied to the electrode wires by an AC voltage source 190. The applied AC establishes an alternating electrostatic field between each pair of wires and the respective donor roll, which is effective in detaching toner from the surface of the donor roll and forming a toner cloud about the wires, the height of the cloud being such as not to be substantially in contact with image bearing surface 10. The magnitude of the AC voltage is in the order of 200 to 500 volts peak at frequency ranging from about 8 kHz to about 16 kHz. A DC bias supply (not shown) applied to each donor roll 176 and 178 establishes electrostatic fields between the image bearing surface 10 and donor rolls for attracting the detached toner particles from the clouds surrounding the wires to the latent image recorded on the photoconductive surface of the image bearing surface.

After development, excess toner remains on the donor rolls 176 and 178 for another trip through the donor roll loading nips 172 and 174. As successive electrostatic latent images are developed, the toner particles within the developer material 166 are depleted. A developer dispenser 105 stores a supply of toner particles, with or without carrier particles. The dispenser 105 is in communication with reservoir 164 and, as the concentration of toner particles in the developer material is decreased (or as carrier particles are removed from the reservoir as in a "trickle-through" system or in a material purge operation as discussed below), fresh material (toner and/or carrier) is furnished to the developer material 166 in the reservoir. The auger 168 in the reservoir chamber mixes the fresh material with the remaining developer material so that the resultant developer material therein is substantially uniform with the concentration of toner particles being optimized. In this way, a substantially constant amount of toner particles is in the reservoir with the toner particles having a constant charge. The developer housing or reservoir 164 may also include an outlet 195 for removing, developer material from the housing in accordance with a developer material purge operation as discussed in detail below. The outlet 195 may further include a regulator (not shown) such as an auger or roller to assist in removing material from the housing.

In one embodiment, various sensors and components within the toner development system 100 are in communication with a system controller 90, which monitors and controls the operation of the toner development system to maintain the toner development system in an optimal state. In addition to the voltage source 190, the donor rolls 176 and 178, the magnetic brush roll 170, the augers 168, the dispenser 105 and the outlet 195, the system controller 90 may, for example, communicate with a variety of sensors, including, for example, sensors to measure toner concentration, toner charge, toner humidity, bias of the magnetic brush roll, and the bias of the donor roll.

When each donor roll 176 or 178 rotates and completes a full rotation, the donor roll 176 or 178 has toner with a different charge/mass ratio than in regions where the toner has been on the roll for multiple revolutions. In particular, the developability may be less for toner in regions of the roll where toner was removed during the previous revolution. This leads to the possibility of a reload error or reload defect, which appears as a light area in the later region. As a result, a "ghost" image of a previous control patch may be printed with a toner image or vice versa.

FIG. 2 illustrates a graph of the toner mass on a region of the donor roll 176 or 178 in the toner development system 100 immediately after printing. As the donor roll 176 or 178 continues to rotate more and more toner will accumulate on the donor roll 176 or 178, thereby replenishing the toner mass on the donor roll 176 or 178. This process may take multiple revolutions of the donor roll 176 or 178. After a sufficient number of rotations, the toner mass at that region of the donor roll 176 or 178 will be completely replenished (mass $M_o$).

A problem arises, however, where an image to be printed requires more toner (mass $M_1$) than that region of the donor roll 176 or 178 might be presently able to provide (mass $M_2$), i.e., before that region of the donor roll 176 or 178 has been replenished with toner. If so, there may be the possibility of a reload artifact or defect appearing in the printed document.

One possible solution is to image control patches in an edge zone on the photoreceptor belt and or other image bearing surface to ensure that the control patches do not interfere with the customer print zone. Such a solution was disclosed, for example in U.S. patent application Ser. No. 11/931,721 filed Oct. 31, 2007, herein incorporated by reference in its entirety. However, for some print systems this may not be feasible.

SUMMARY

According to one aspect of the present disclosure, a method for controlling an image printing system in the presence of reload defects is provided. The method comprises placing toner images on an image bearing surface moving in a process direction, determining the density of the toner image or a portion thereof being printed on the image bearing surface, and printing a scheduled control patch at a location in a cross-process direction on the image bearing surface, wherein the location where each control patch is printed is dynamically changed based on the density of the toner image adjacent the control patch or a portion thereof.

According to another aspect of the present disclosure, a system for controlling an image printing system in the presence of reload defects is provided. The system comprises an image bearing surface and a controller. The image bearing surface is moving in a process direction and is configured to receive toner images and control patches. The controller is configured to determine a location in a cross-process direction for printing a scheduled control patch on the image bearing surface, wherein the location where each control patch is printed is dynamically changed based on the density of the toner image adjacent the control patch or a portion thereof.

Other objects, features, and advantages of one or more embodiments of the present disclosure will seem apparent from the following detailed description, and accompanying drawings, and the appended claims.

BRIEF DESCRIPTION OF THE DRAWINGS

Various embodiments will now be disclosed, by way of example only, with reference to the accompanying schematic drawings in which corresponding reference symbols indicate corresponding parts, in which.

DETAILED DESCRIPTION

The present disclosure proposes dynamically changing the location of where the control patches are printed within the inter-document zone (IDZ) based on the density of the toner image. This dynamic placement of the control patches based on customer or toner image content (e.g., where the density of toner image is less than a certain density threshold) would minimize or eliminate the possibility of the toner image impacting the control patch or the control patch impacting the toner image, when reload performance of the toner development system has degraded. The present disclosure may use a linear array sensor to detect the control patches and thus the placement of the control patches is not restricted within the inter-document zone (IDZ) to the location of the enhanced area toner coverage (ETAC) sensor.

The present disclosure proposes a method for controlling an image printing system in the presence of reload defects. The method comprises placing toner images on an image bearing surface moving in a process direction, determining the density of the toner image or a portion thereof that was printed on the image bearing surface, and subsequently printing a scheduled control patch at a location on the image bearing surface, wherein the location where the control patches are printed is dynamically changed based on the density of the toner image. The present disclosure proposes the use of a linear array sensor to detect the control patches and thus enables adjustment of the lateral location of the control patches anywhere in the inter-document zone (IDZ).

The image printing system generally has two important dimensions: the process (or slow scan) direction and the cross-process (or fast scan) direction. The direction in which the image bearing surface moves is referred to as process (or slow scan) direction, and the direction in which the plurality of sensors are oriented is referred to as cross-process (or fast scan) direction. The cross-process (or fast scan) direction is generally perpendicular to the process (or slow scan) direction.

The density of the customer or toner image may be determined from analysis of the digital image ahead of time. Based on the density threshold and the customer or toner image, the process control patches would be placed within the inter-document zone (IDZ) at known locations. The linear array sensor would then analyze the inter-document zone (IDZ) at those locations and feed the data into the machine control. This dynamic placement of the control patches based on customer or toner image content (e.g., where the density of customer or toner image is less than a certain density threshold) would eliminate the possibility of the customer or toner image impacting the control patch, or the control patch impacting the customer or toner image, when reload performance of the toner development system has degraded.

Figure 3:
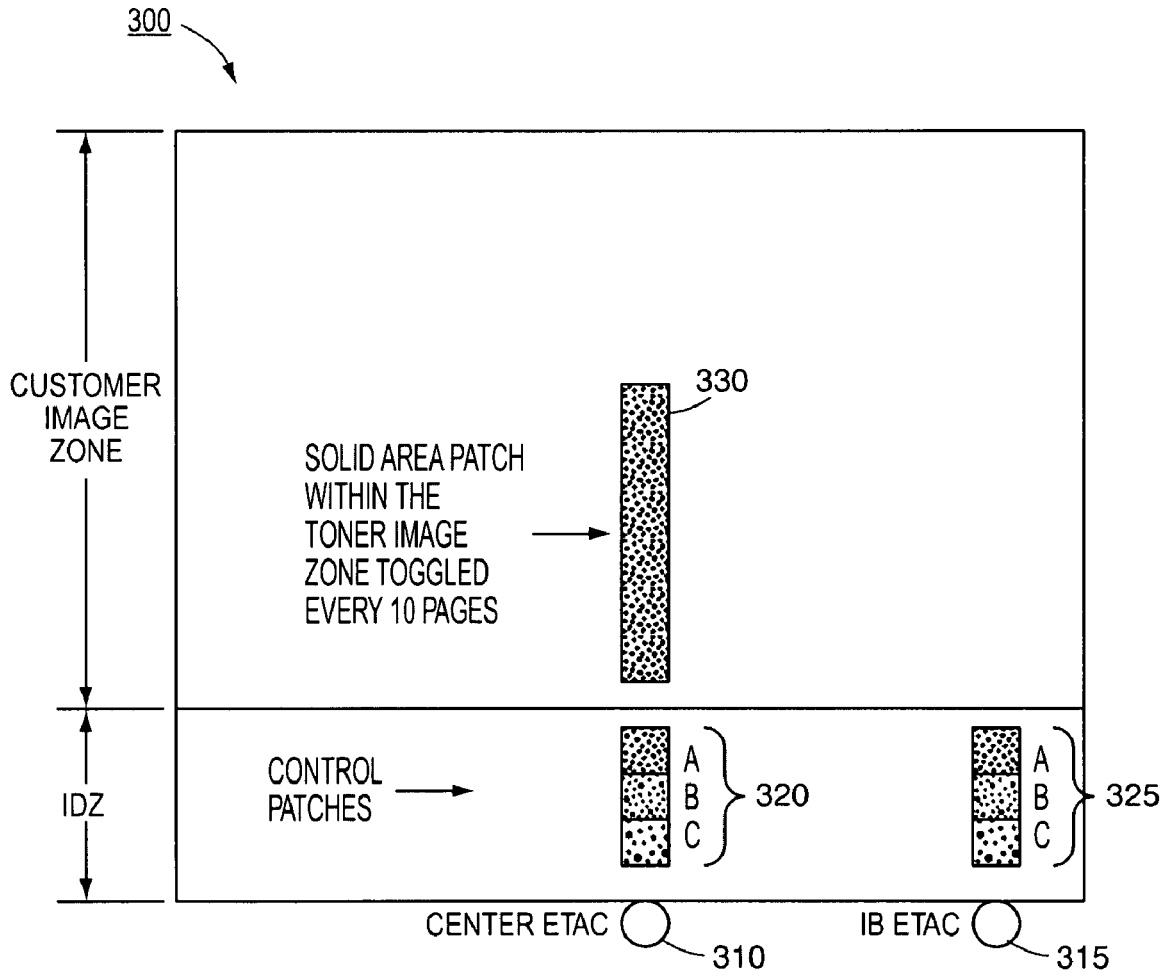
FIG. 3 illustrates a test arrangement used to determine the relative impact that the placing toner images has on control patches.

A test was performed to determine the impact of placing toner images in close proximity to control patches had on the occurrence of reload defects. FIG. 3 illustrates one exemplary test arrangement used in the present disclosure. A plurality of customer image zones and inter-document zones (IDZ) are positioned, for example, on a portion of an image bearing surface 300 in an image printing system.

The test was carried out using a Xerox iGen3® digital printing press. A pair of enhanced toner area coverage (ETAC) sensors 310, 315, were positioned to sense control patches in the center position and lateral position on the image bearing surface 300 of the image printing system. The lateral sides of the image bearing surface 300 may be referred to as the inboard (IB) and outboard (OB) positions relative to an operator's position. In this scenario, the second sensor 315 was position at the inboard position (i.e., closest to the operator).

The present disclosure uses a linear array sensor (e.g., a full width array sensor) to detect the control patches, however, a pair of enhanced toner area coverage (ETAC) sensors 310, 315 were used to detect the control patches only as part of this test arrangement.

A solid area patch 330 was provided in the customer image zone in-line with a first control patch 320 to simulate the impact on of a high density toner image on the control patches. The solid area patch 330 and the first control patch 320 were both sensed using the center ETAC sensor 310.

A second control patch 325 was positioned at the inboard (IB) side of the inter-document zone (IDZ) with no corresponding solid area patch in the customer image zone as a control, which would not be effected by the solid area patch 330. The second control patch 325 was sensed using the inboard ETAC sensor 315.

The first and second control patches 320, 325 were essentially identical and each included a solid area patch 320A, 325A (100% AC), a mid-density patch 320B, 325B (67% AC), and a low-density patch 320C, 325C (17% AC).

The test was run for a total of 50 pages, with each page corresponding to an adjacent customer image zone and an inter-document zone (IDZ) on the image bearing surface 300. The solid area patch 330 in the customer image zone was toggled on for every other set of 10 pages (i.e. when pages 11-20 and 31-40 were printed).

Figure 4:
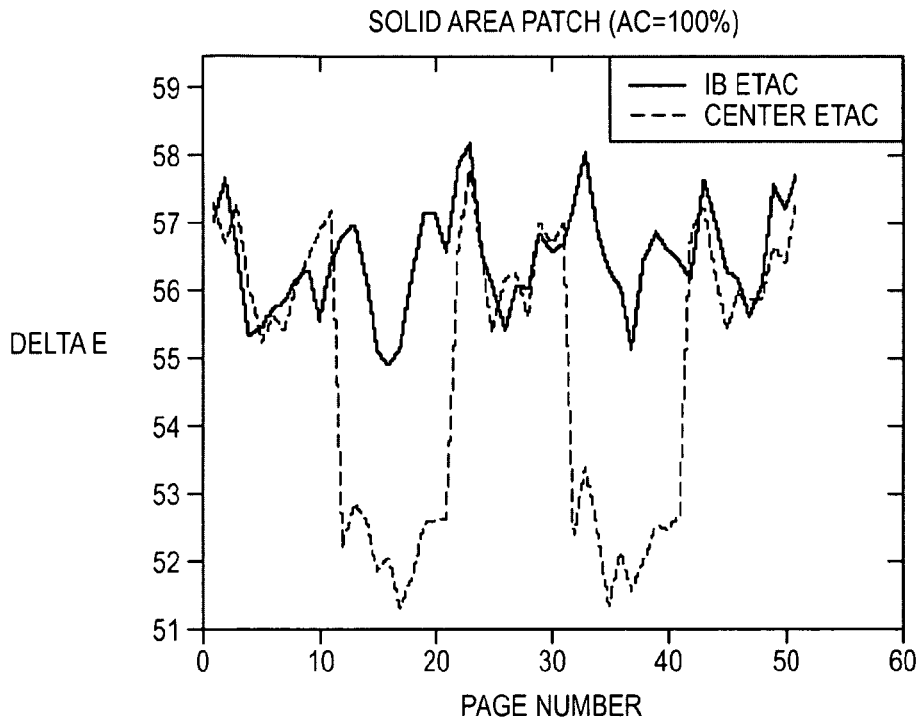
FIG. 4 illustrates a graph of the sensor readings for the inboard ETAC and center ETAC sensors when sensing the solid area patch of the control patches.
Figure 5:
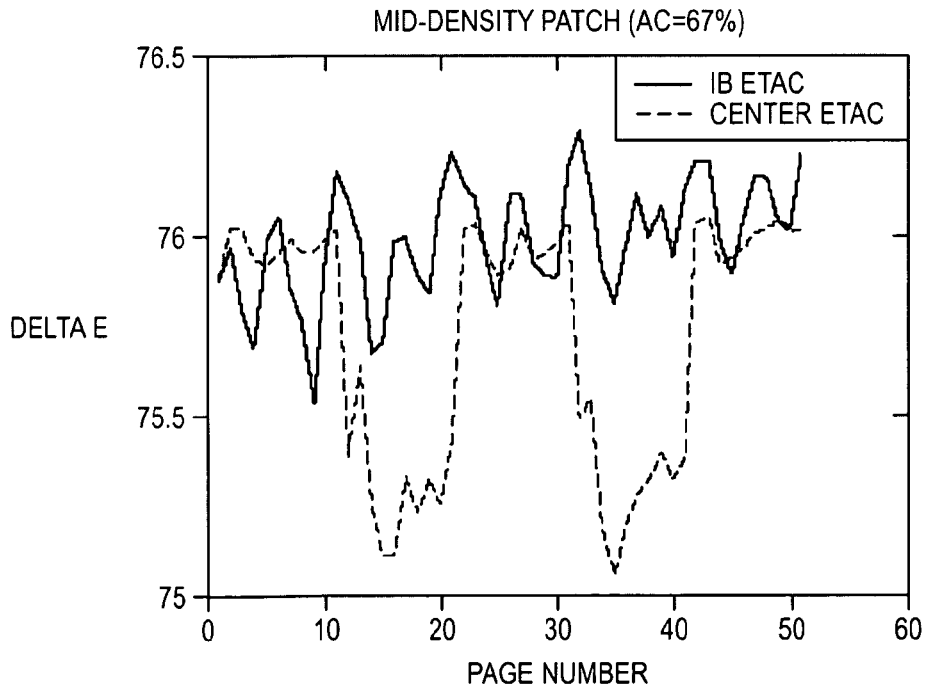
FIG. 5 illustrates a graph of the sensor readings for the inboard ETAC and center ETAC sensors when sensing the mid-density patch of the control patches.
Figure 6:
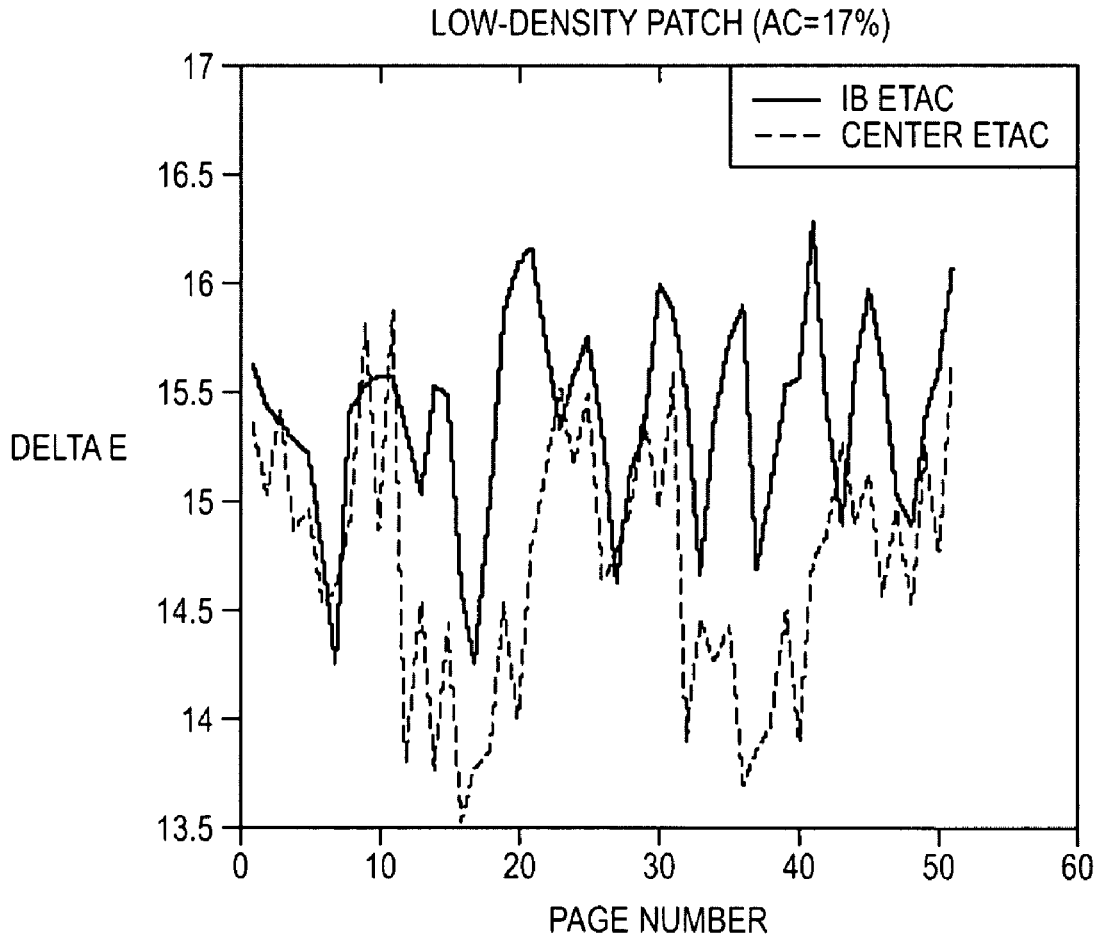
FIG. 6 illustrates a graph of the sensor readings for the inboard ETAC and center ETAC sensors when sensing the low-density patch of the control patches.

FIGS. 4-6 illustrate graphs of sensor readings for the IB ETAC and center ETAC sensors, and the impact that toggling the solid area patch 330 in the customer image zone had on the high-density patch, the mid-density patch, and the low-density patch, respectively. In the graphs of FIGS. 4-6, the Y-axis represents the sensor readings for the IB ETAC and center ETAC sensors and the X-axis represents the page numbers. The sensor readings were measured in Delta-E units.

A spectrophotometer measures color and provides the results of the measurements in a format known as L*a*b* or, more simply, Lab. L*a*b* is a three-dimensional color space where L* is the luminance of the sample, and a* and b* are the color components of the sample. If a* and b* are both zero, the result is a neutral color. If two colors are measured using a densitometer and the L*a*b* values are plugged into the following formula:

$$dE^2=(L1-L2)^2+(a1-a2)^2+(b1-b2)^2$$

The resulting number is referred to as Delta-E or the color difference.

It is apparent from the results, that printing the solid area patch 330 in the customer image zone impacted the subsequent printing of the first control patch 320. For example, referring to pages 11-20 and 31-40, where there was a solid area patch 330 that had been printed in the customer image zone, there was a large shift in density for the solid area or solid area patch (FIG. 4) and the mid-patch (FIG. 5). Moreover, the results show that the density shift for the mid-density patch was most significantly impacted.

By contrast, the low-density patches (FIG. 6) did not exhibit a significant shift in density, for pages 11-20 and 31-40, where there was a solid area patch 330 printed in the customer image zone. This suggests that the control patches could be scheduled based on the density of the toner image.

Also, the sensor readings for IB ETAC sensor 315, which measured the control patches (e.g., control patch 325) with no influence of the toner image, remained relatively unchanged for all the three patches (i.e., the high-density patch, the mid-density patch, and the low-density patch) in comparison to the readings for the center ETAC sensor 310.

The results of this test demonstrate the significant detrimental effect recognized by the inventors that the toner image has on printing control patches. This test shows that if the control patches are placed within the inter-document zone (IDZ) where the density of the toner image fell below a predetermined density threshold then the toner image cannot significantly affect the control patches and vice versa.

Thus, a method is provided to control an image printing system in the presence of reload defects. The disclosed embodiments minimize and/or eliminate the possibility that the toner image negatively impacts the control patch, and vice versa.

Figure 7:
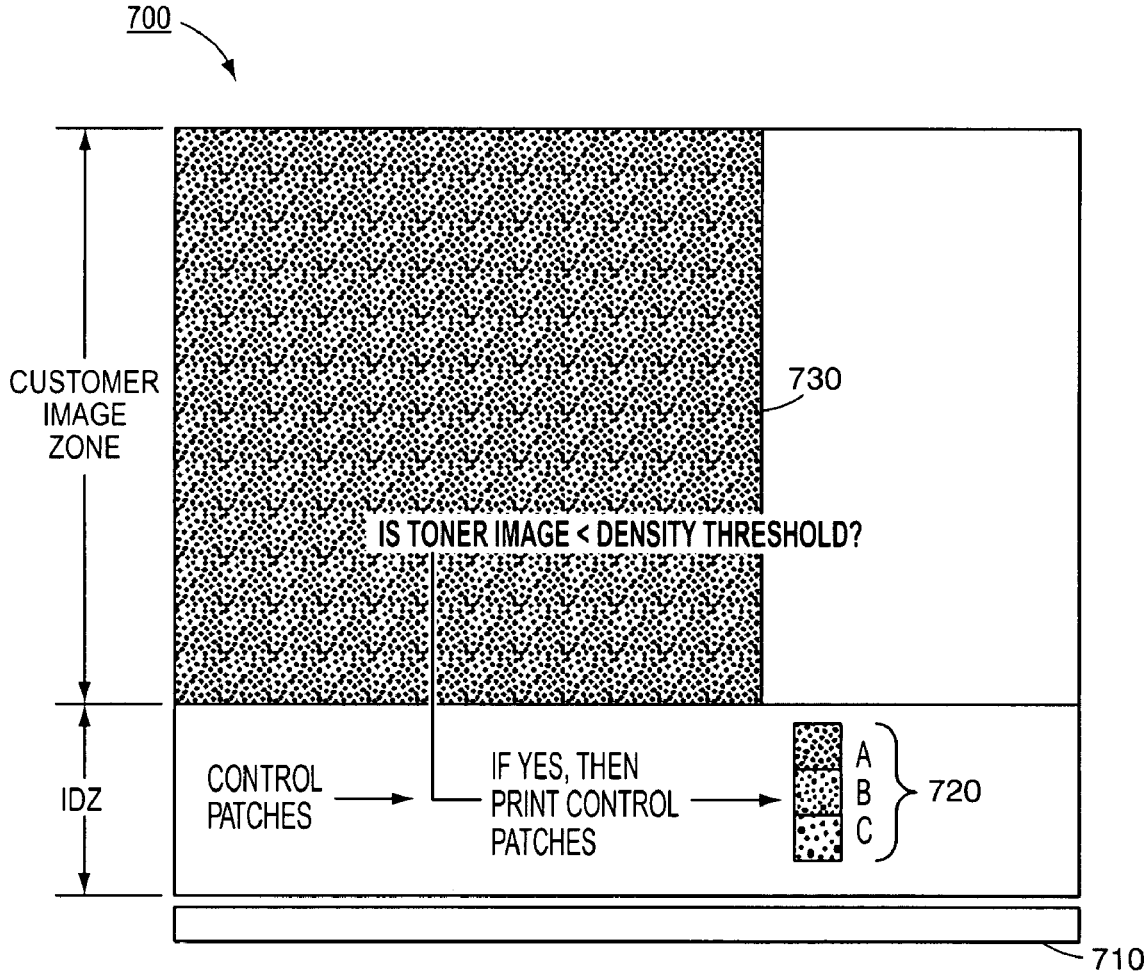
FIG. 7 illustrates printing of a control patch and detecting the printed control patch using a linear array sensor in accordance with an embodiment of the present disclosure.

FIG. 7 illustrates printing a control patch and detecting the control patch using a linear array sensor in accordance with an embodiment of the present disclosure.

A portion of an image bearing surface 700, for example, from an image printing system is shown and generally includes a plurality of customer image zones and inter-document zones (IDZ). The customer images zones and the inter-document zones (IDZ) may be spaced in an alternating manner on the image bearing surface 700. Generally, control patches and other diagnostic targets are printed in inter-document zones (IDZ) of the image bearing surface 700 while toner images of the print job are printed on customer image zones, although this need not always be the case.

In one embodiment, the image bearing surface 700 of the image printing system is selected from the group consisting of a photoreceptor drum, a photoreceptor belt, an intermediate transfer belt, and an intermediate transfer drum. That is, the term image bearing surface means any surface on which a toner image is received, and this may be an intermediate surface (i.e., a drum or belt on which a toner image is formed prior to transfer to the printed document). For example, a "tandem" xerographic color printing systems (e.g., U.S. Pat. Nos. 5,278,589; 5,365,074; 6,904,255 and 7,177,585, each of which are incorporated by reference), typically include plural print engines transferring respective colors sequentially to an intermediate image transfer surface (e.g., belt or drum) and then to the final substrate.

A sensor 710 is positioned proximate to the image bearing surface 700 and is configured to sense control patches 720 in inter-document zones (IDZ) and images in the customer image zones. In one embodiment, the sensor 710 is a linear array sensor. In one embodiment, the linear array sensor 710 is extending in a cross-process direction and is adjacent to the image bearing surface 700.

Preferably, the linear array sensor 710 is, for example, a full width array (FWA) sensor. A full width array sensor is defined as a sensor that extends substantially an entire width (perpendicular to a direction of motion) of the moving image bearing surface 700. The full width array sensor is configured to detect any desired part of the printed image or control patches, while printing real images. The full width array sensor may include a plurality of sensors equally spaced at intervals (e.g., every 1/600th inch (600 spots per inch)) in the cross-process (or a fast scan) direction. See for example, U.S. Pat. No. 6,975,949, incorporated herein by reference. It is understood that other linear array sensors may also be used, such as contact image sensors, CMOS array sensors or CCD array sensors. Although the full width array (FWA) sensor or contact sensor is shown in the illustrated embodiment, it is contemplated that the present disclosure may use sensor chips that are significantly smaller than the width of the image bearing surface, through the use of reductive optics. In one embodiment, the sensor chips may be in the form of an array that is, for example, one or two inches long and that manages to detect the entire area across the image bearing surface through reductive optics. In one embodiment, the linear array sensor 710 may be any suitable sensor capable of detecting variations in reflectance across an image, such as a spectrophotometer. In one embodiment, a processor is provided to both calibrate the linear array sensor and to process the reflectance data detected by the linear array sensor. It could be dedicated hardware like ASICs or FPGAs, software, or a combination of dedicated hardware and software.

The control patch 720 may include a solid area/high-density patch 720A (100% AC), a mid-density patch 720B (67% AC), and a low-density patch 720C (17% AC). See, for example, U.S. Pat. No. 6,016,204, mentioned above. Other control patches and geometries may similarly be provided.

In one embodiment, a controller is provided to manage the printing of scheduled control patches immediately after printing a toner image. In particular, only if the controller determines that the density of the toner image that was just printed is less than a predetermined-threshold will the scheduled control patch be printed. Otherwise, the controller will dynamically change the location where the control patch will be printed to a location where the density of the toner image is less than the predetermined density threshold.

Figure 8A:
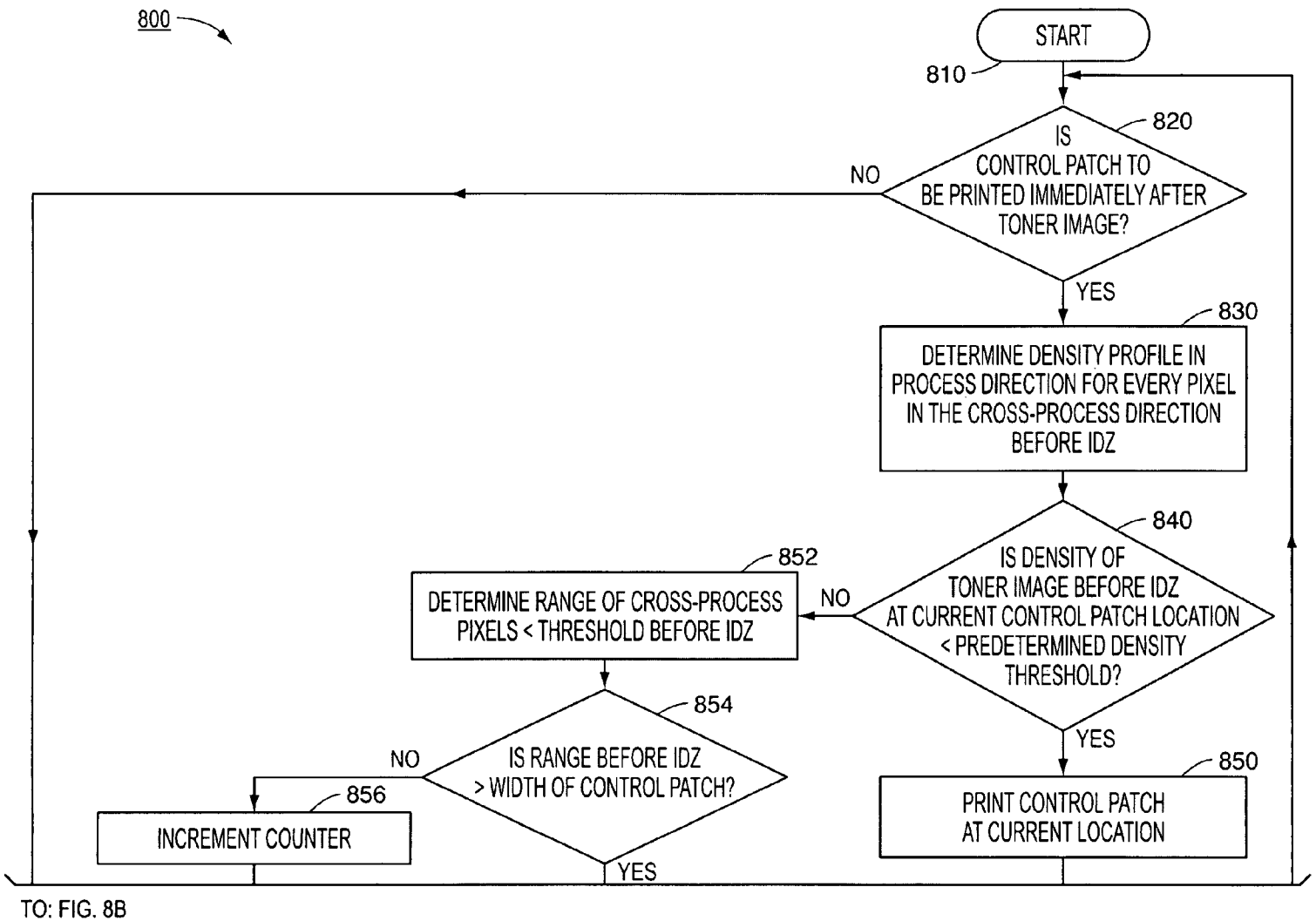
FIGS. 8A and 8B illustrate a method for controlling the image printing system in the presence of reload defects, wherein the control patch is to be printed immediately after a toner image in accordance with an embodiment of the present disclosure.
Figure 8B:
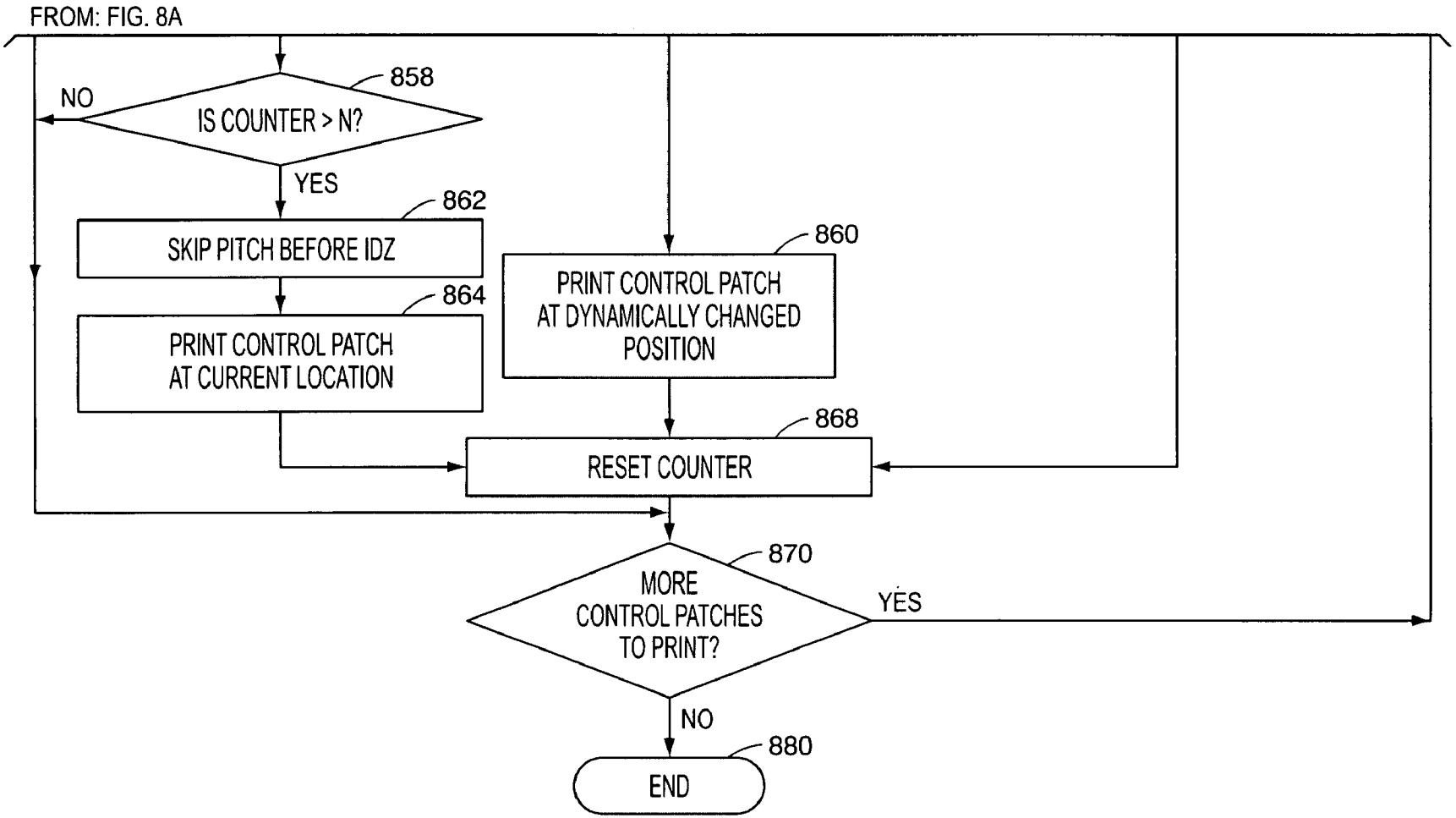

FIGS. 8A and 8B illustrate a method 800 for controlling the image printing system in the presence of reload defects in accordance with an embodiment of the present disclosure. The method 800 begins at procedure 810. At procedure 820, a controller determines whether a scheduled control patch is to be printed immediately after a toner image. If not, the method 800 proceeds to procedure 870.

At procedure 830, the controller determines the density of the toner image and its various regions that have just been printed. This data may be provided to the controller by a linear array sensor, e.g., a full width array (FWA) sensor. The density profiles in process direction for every pixel along in the cross-process direction (as explained with respect to FIG. 11) before the inter-document zone are used to determine the density of the toner image and its various regions that have just been printed.

Alternatively, the density of the toner image and its various regions may be inferred from the digital image content input to the image printing system. The input image data may be provided from the print controller (not shown) of the image printing system. The Xerox FreeFlow™ DocuSP™ digital front end (DFE), for example, includes a 40 page look-ahead at a resolution of 75 dpi which may be used to infer the density of an upcoming toner image.

The print controller sends both the input image data from the image, and the control information to the marking engines. The print controller may include a raster image processor (RIP) that accepts an input Page Description, for example, as described by a page description language (PDL), such as Adobe® PostScript®, and produces a bitmap. Generally, for graphics and text, the color representation in PostScript is 'real,' or floating point, and is represented in 32 or 64 bits. For objects that are images (e.g., a JPG file), they are generally 8 bits per color separation (CMYK), but can also be 12 or 16 bits (though this is not as common). Where the PDL of the incoming image data is different from the PDL used by the image printing system, a suitable conversion unit (not shown) located in the interface unit may convert the incoming PDL to the PDL used by the digital printing system.

The bitmap may be passed to an image output terminal (IOT) interface of the image printing system. The IOT interface may further perform image processing to make corrections or compensations to correct for deviations in the printing process. Grayscale image data is advantageously provided to the IOT interface because binary data cannot be easily image processed, without more complicated image processing to convert it back to something like grayscale.

For 8 bit color separations, for example, each pixel will have a value between 0 and 255. Thus, for a given region of an image, the density may be determined based on the predominant density of pixels therein. In one implementation, an averaging algorithm may be used to determine an average value of the pixels in that region for that color separation. These values may be divided by 255 to give an inferred density value between 0.0 (0% AC) and 1.0 (100% AC) for a particular color.

Figure 11:
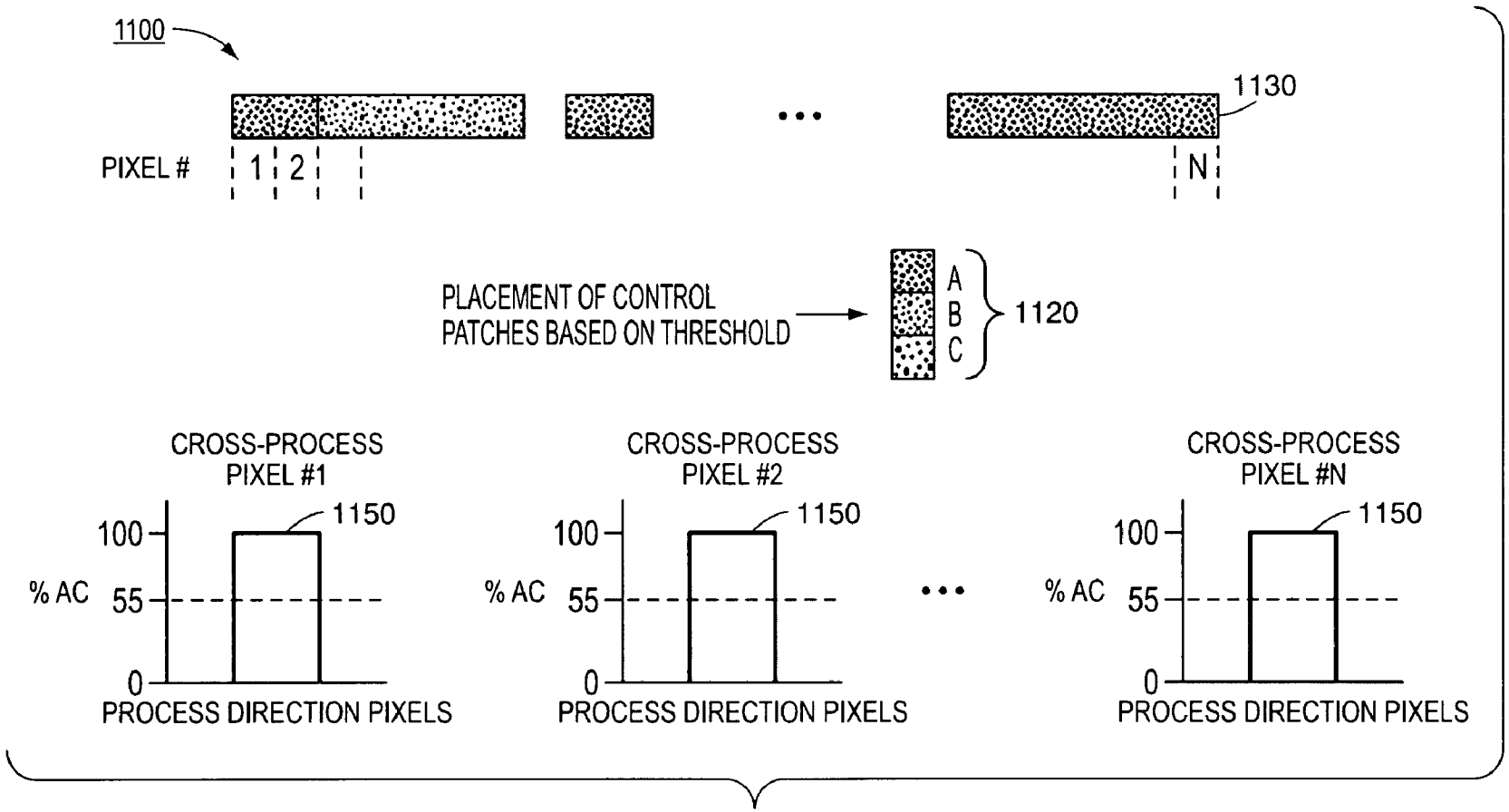
FIG. 11 illustrates a method for analyzing the toner image, wherein the toner image is located before the control patch in accordance with an embodiment of the present disclosure.
Figure 12:
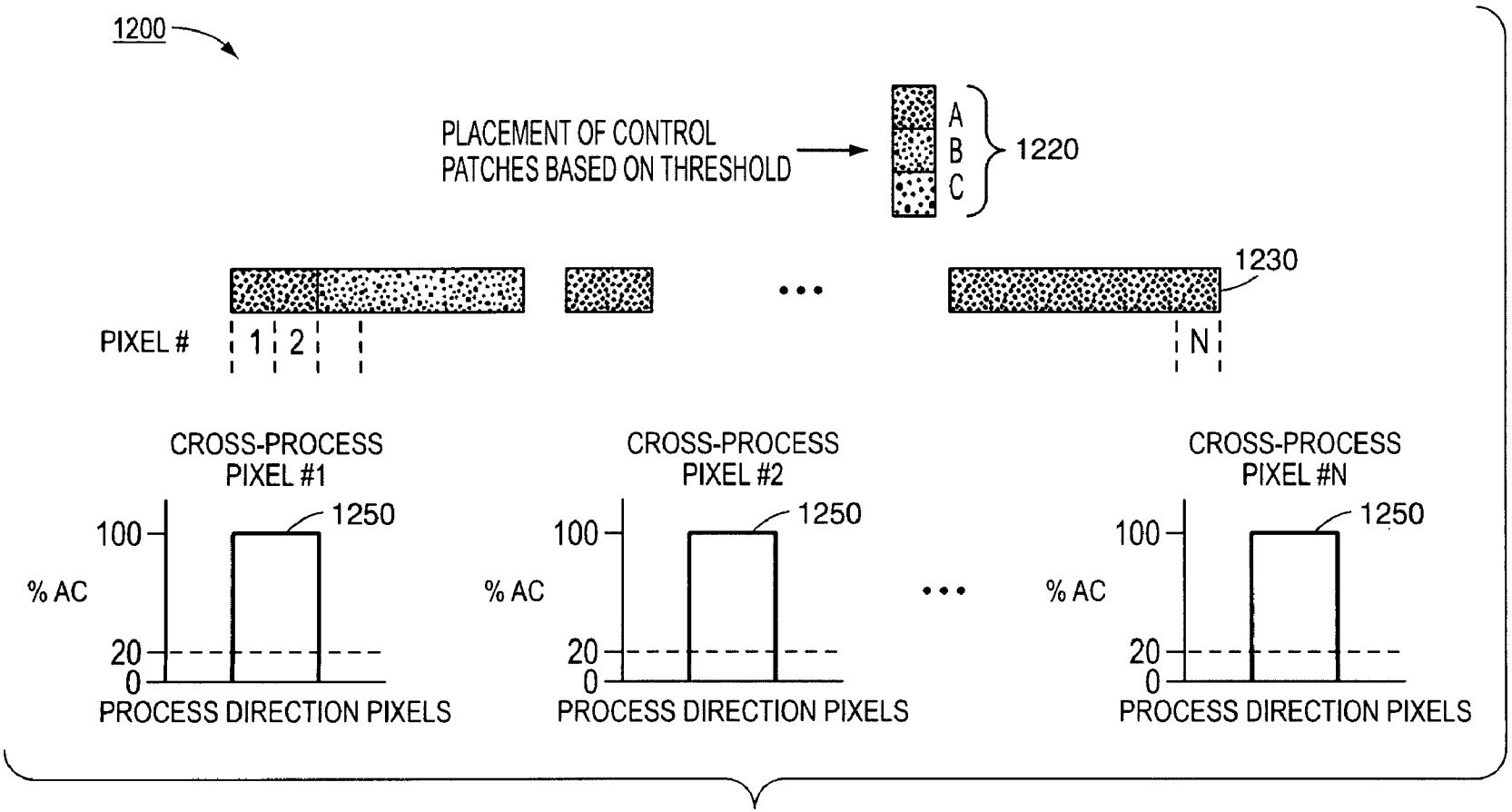
FIG. 12 illustrates a method for analyzing the toner image, wherein the toner image is located after the control patch in accordance with an embodiment of the present disclosure.

In one embodiment, as shown in FIGS. 11 and 12, the density profiles in the process direction for each pixel in cross-process direction are developed. These density profiles 1150 for each pixel along the cross-process direction are used to determine the density of the toner image and its various regions before the IDZ as shown in FIG. 11. For example, three density profiles 1150 are shown in FIG. 11 that correspond to the density profiles of the cross process pixel 1, cross process pixel 2, and cross process pixel N, where N is number of the cross process pixels in the toner image 1130. Similarly, as shown in FIG. 12, the density profiles 1250 in process direction for each pixel along with cross-process direction are used to determine the density of the toner image and its various regions after the IDZ. For example, three density profiles 1250 are shown in FIG. 12 that correspond to the density profiles of the cross process pixel 1, cross process pixel 2, and cross process pixel N, where N is number of the cross process pixels in the toner image 1230.

At procedure 840, the controller compares the density of the toner image located before the inter-document zone at a current control patch location with a predetermined density threshold. This may be a Boolean operation. If the toner image is light enough (i.e., low density) not much toner from the donor roll will be needed to print the image and it will not substantially affect the subsequent printing of the control patch.

Next, at procedure 850, the scheduled control patch will be printed at a standard location if the density of the toner image is less than the predetermined density threshold. If not, in procedure 852, the controller determines a range of cross-process direction pixels where the density of the toner image and its various regions (e.g., located before the control patch) that have just been printed that are less than the predetermined density threshold. In order to print a control patch, a range of cross-process direction pixels is to be determined where the density of the toner image is less than the predetermined density threshold. This is done by first determining a cross-process direction pixel where the density of the toner image is less than the predetermined density threshold. Then, a plurality of neighboring cross-process direction pixels for the current cross-process direction pixel is determined, where the plurality of neighboring cross-process direction pixels have the density of the toner image less than the predetermined density threshold.

In one embodiment, the control patch to be printed has a predetermined width that may be equal to a range of cross-process direction pixels. At procedure 854, a comparison between the range of cross-process direction pixels before the inter-document zone (IDZ) and the width of the control patch is done.

If the range of cross-process direction pixels before the inter-document zone (IDZ) is greater than the width of the control patch, then at procedure 860, the location where the control patch will be printed is dynamically changed to a location in the cross-process direction where the density of the toner image is less than the predetermined density threshold.

If the range of cross-process direction pixels before the inter-document zone (IDZ) is not greater than the width of the control patch, then at procedure 856, a counter is incremented. In one embodiment, a counter is used by the controller of the method 800. In one embodiment, the counter may have a predetermined threshold. In one embodiment, the predetermined threshold is two minutes or any other predetermined amount of time. In one embodiment, the predetermined threshold is number of prints, for example, 500 prints or any other predetermined amount of prints. At procedure 858, the value of the counter is compared with the predetermined threshold of the counter, and if the value of the counter is greater than the predetermined threshold N, the method 800 proceeds to procedure 862. At procedure 862, the controller will skip one or more pitches before the inter-document zone, and then print the control patch at procedure 864 before resetting the counter at procedure 868.

At procedure 870, if further toner images are to be printed (i.e., the print job not completed), the method 800 returns to procedure 820. Otherwise, the method 800 ends at procedure 880.

In one embodiment, the predetermined density threshold of the toner image that is located before the control patch is approximately 55%. In other words, a scheduled control patch will be printed immediately after a toner image has been printed, only if the density of the toner image is less than about 55%. Otherwise, if the density of the toner image is greater than about 55%, the subsequent printing of the control patch may cause a reload defect to occur. Therefore, in such a case where the density of the toner image is greater than about 55%, the cross-process location where the control patch is printed is dynamically changed to a location where the density of the toner image is less than about 55% (or whatever threshold is being used). In other words, the control patch is aligned with an area of the toner image where the density of the toner image is less than the 55% so as to eliminate the possibility of the toner image impacting the control patch when reload performance of the toner development system has degraded.

Figure 9A:
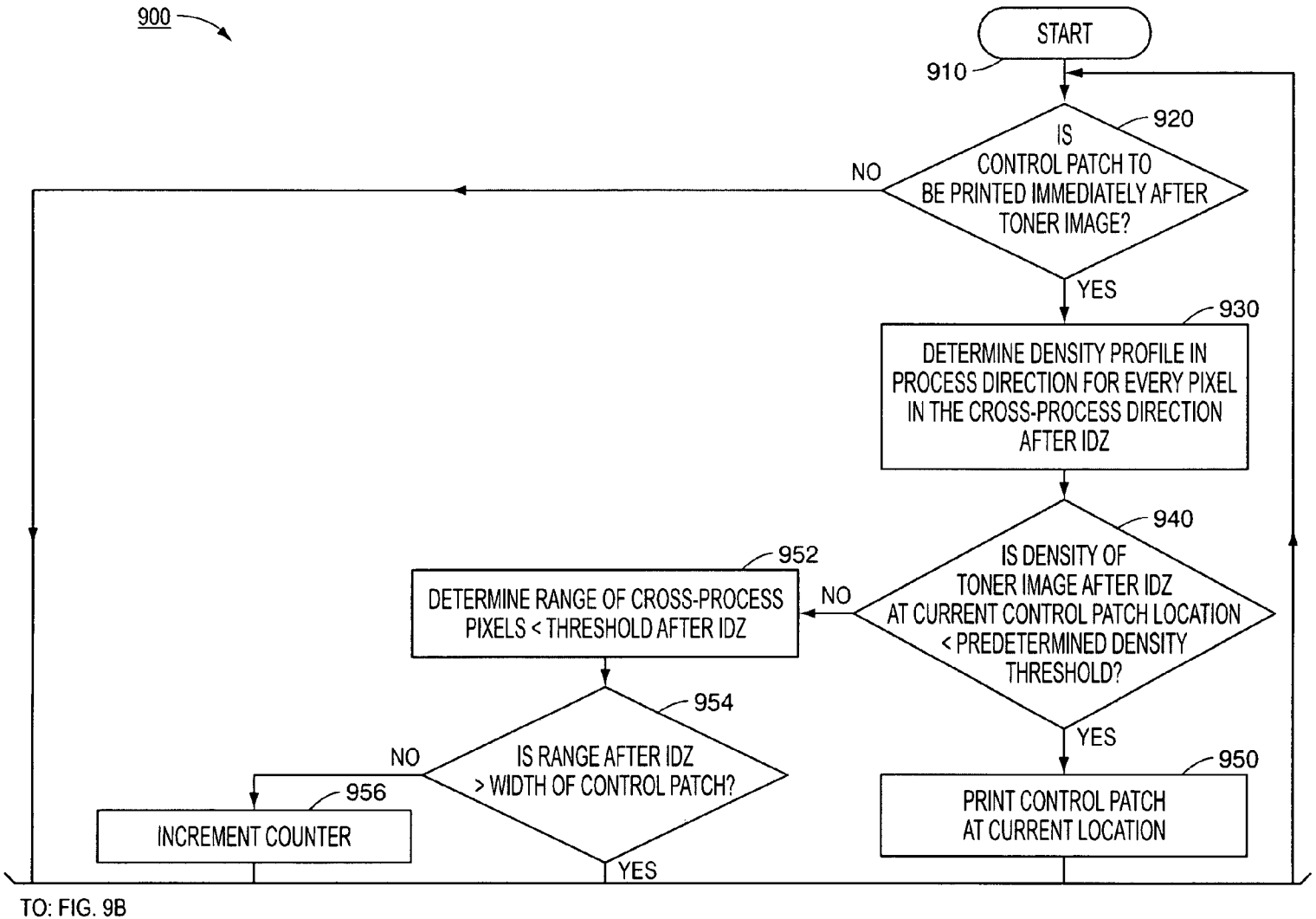
FIGS. 9A and 9B illustrate a method for controlling the image printing system in the presence of reload defects, wherein the control patch is to be printed immediately before a toner image in accordance with an embodiment of the present disclosure.
Figure 9B:
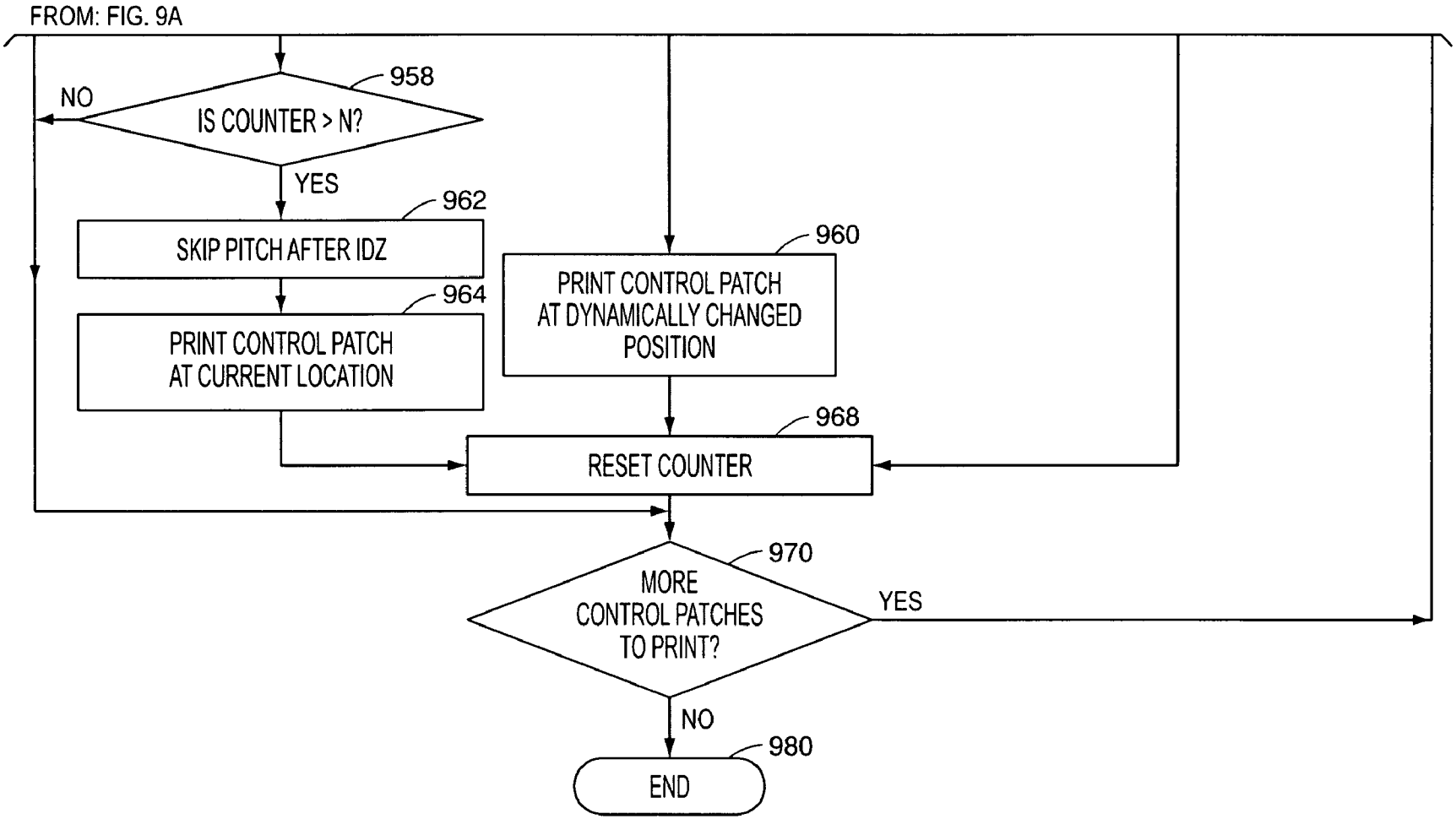

FIGS. 9A and 9B illustrate a method 900 for controlling the image printing system in the presence of reload defects in accordance with an embodiment of the present disclosure. The method 900 is similar to the method 800 discussed above, but, is used in the case where the control patch is to be printed immediately before the toner image. The method 900 begins at procedure 910. At procedure 920, a controller determines whether a scheduled control patch is to be printed immediately before a toner image. If not, the method 900 proceeds to procedure 970. At procedure 930, the controller determines the density of the toner image and its various regions that are to be printed. The density profiles in process-direction for every pixel along in the cross-process direction (as explained with respect to FIG. 12) after the inter-document zone are used to determined the density of the toner image and its various regions that are to be printed.

At procedure 940, the controller compares the density of the toner image located after the inter-document zone at a current control patch location with a predetermined density threshold. Next, at procedure 950, the scheduled control patch will be printed at a standard location if the density of the toner image is less than the predetermined density threshold. If not, in procedure 952, the controller determines a range of cross-process direction pixels where the density of the toner image and its various regions (e.g., located after the control patch) that have to be printed that are less than the predetermined density threshold. In order to print a control patch, a range of cross-process direction pixels is to be determined where the density of the toner image is less than the predetermined density threshold. This is done by first determining a cross-process direction pixel where the density of the toner image is less than the predetermined density threshold. Then, a plurality of neighboring cross-process direction pixels for the current cross-process direction pixel is determined, where the plurality of neighboring cross-process direction pixels have the density of the toner image less than the predetermined density threshold.

In one embodiment, the control patch to be printed has a predetermined width that may be equal to a range of cross-process direction pixels. At procedure 954, a comparison between the range of cross-process direction pixels after the inter-document zone (IDZ) and the width of the control patch is done.

If the range of cross-process direction pixels after the inter-document zone (IDZ) is greater than the width of the control patch, then at procedure 960, the location where the control patch will be printed is dynamically changed to a location in the cross-process direction where the density of the toner image is less than the predetermined density threshold.

If the range of cross-process direction pixels after the inter-document zone (IDZ) is not greater than the width of the control patch, then at procedure 956, a counter is incremented. In one embodiment, a counter is used by the controller of the method 900. In one embodiment, the counter may have a predetermined threshold. In one embodiment, the predetermined threshold is two minutes or any other predetermined amount of time. In one embodiment, the predetermined threshold is number of prints, for example, 500 prints or any other predetermined amount of prints. At procedure 958, the value of the counter is compared with the predetermined threshold of the counter, and if the value of the counter is greater than the predetermined threshold, the method 900 proceeds to procedure 962. At procedure 962, the controller will skip one or more pitches before the inter-document zone, and then print the control patch at procedure 964 before resetting the counter at procedure 968.

At procedure 970, if further toner images are to be printed (i.e., the print job not completed), the method 900 returns to procedure 920. Otherwise, the method 900 ends at procedure 980.

In addition, or instead of, making a decision as to the location of a control patch based on the content of a toner image that has been printed as discussed in the method 800, the controller in method 900 may make such a decision based on the content of a toner image that is to be printed. That is, the location decision for the control patch may take into account the content of the toner image that is to be printed subsequently to the control patch. For example, in one embodiment, the predetermined density threshold of the toner image that is located after the control patch is approximately 20% (although another threshold may be used). In other words, the customer image will be printed immediately after a control patch has been printed, only if the density of the toner image is less than about 20%. Otherwise, if the density of the toner image is greater than about 20%, the reload defect could occur. Therefore, in such a case where the density of the toner image is greater than about 20%, the location where the control patch is printed is dynamically changed to a location where the density of the toner image is less than about 20%. In other words, the control patch is aligned with an area of the toner image where the density of the toner image is less than the 20% so as to eliminate the possibility of the control patch impacting the toner image when reload performance of the toner development system has degraded.

Figure 10A:
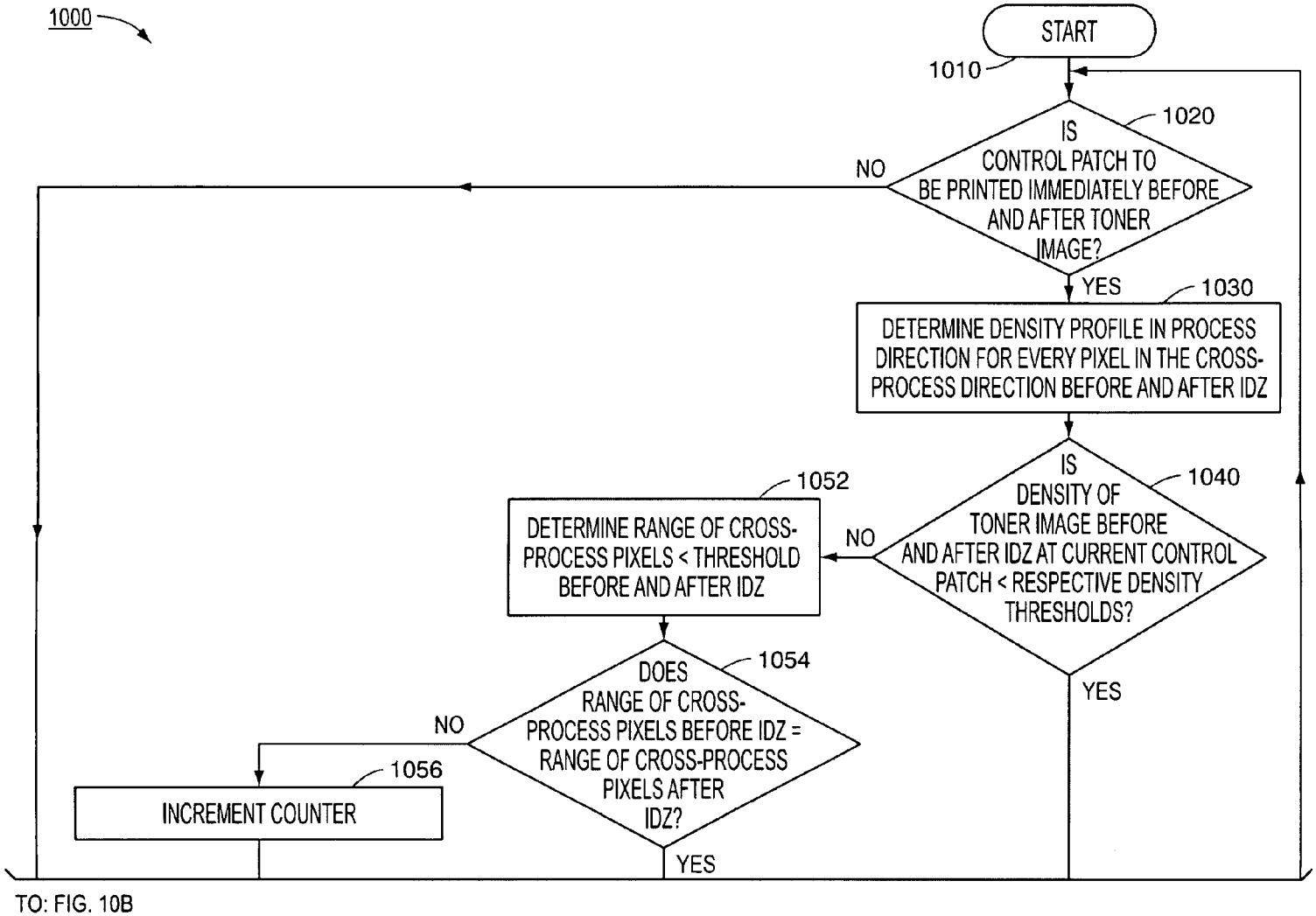
FIGS. 10A and 10B illustrate a method for controlling the image printing system in the presence of reload defects, wherein the toner images are printed immediately before and after the control patch in accordance with an embodiment of the present disclosure.
Figure 10B:
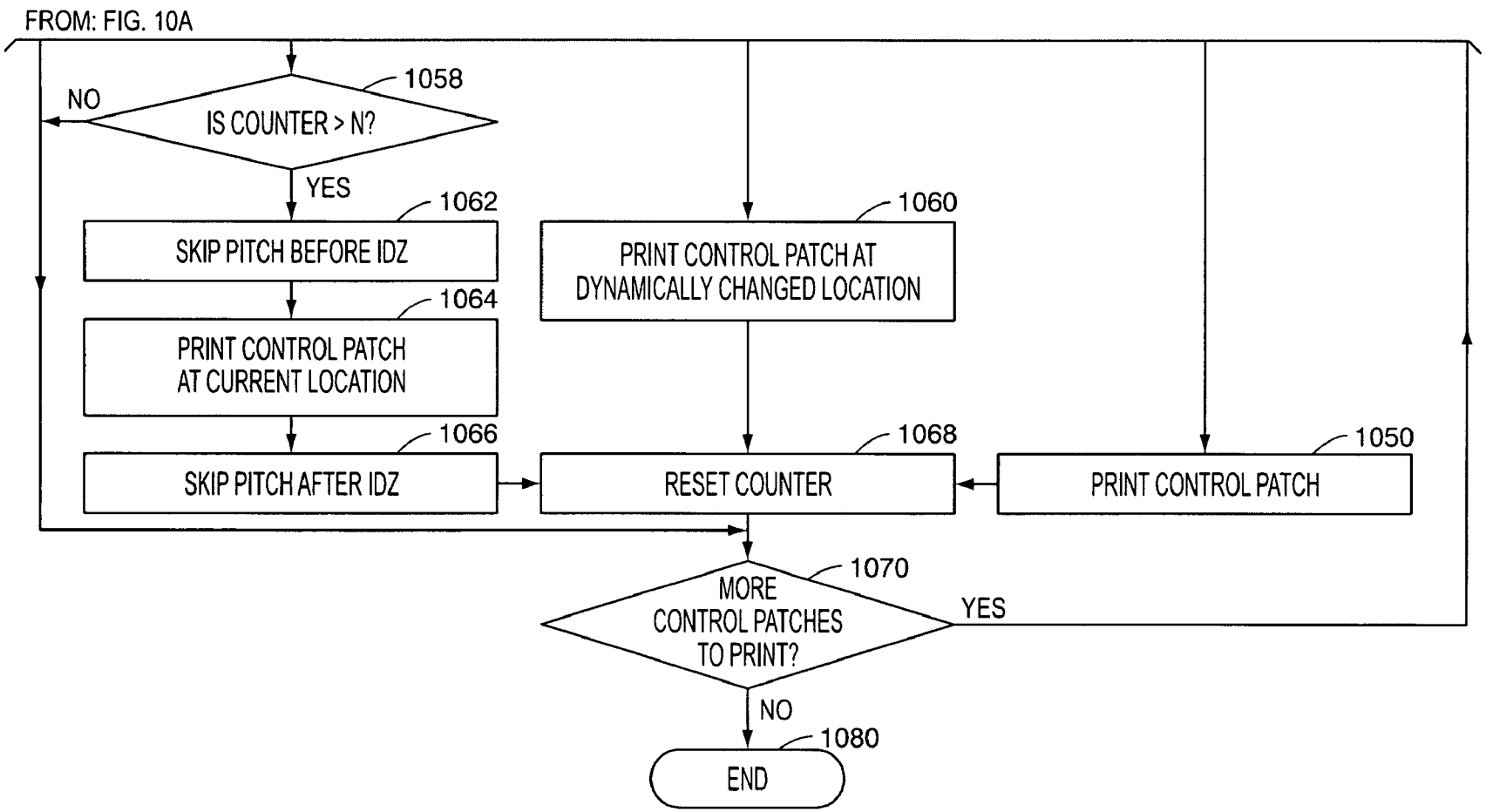

FIGS. 10A and 10B illustrate a method 1000 for controlling the image printing system in the presence of reload defects in accordance with an embodiment of the present disclosure. The method 1000 is similar to the methods 800 and 900 discussed above, but, is used in the case where the control patch is to be printed immediately before one toner image, and immediately after another toner image.

The method 1000 begins at procedure 1010. At procedure 1020, a controller determines whether a scheduled control patch is to be printed immediately before and after the inter-document zone. If not, the method 1000 proceeds to procedure 1070.

At procedure 1030, the controller determines the density of the toner image and its various regions that have just been printed and the density of the toner image and its various regions that are to be printed. In other words, the density of the toner image before and after the inter-document zone (IDZ) is determined at procedure 1030. As explained above with reference to FIGS. 11 and 12, in step 1030, the density profiles in process-direction for every pixel in the cross-process direction are determined before and after the inter-document zone. These density profiles are used to determine the density of the toner image and its various regions that have just been printed and the density of the toner image and its various regions that are to be printed.

At procedure 1040, the controller compares the density of the toner image before and after the inter-document zone (IDZ) at current patch location with respective predetermined density thresholds. In one embodiment, as discussed above, the control patch is printed in the inter-document zone (IDZ) between the toner images. Next, at procedure 1050, the scheduled control patch will be printed at a standard location if the density of the toner image before and after the inter-document zone (IDZ) is less than the respective predetermined density thresholds.

If not, in procedure 1052, the controller determines a range of cross-process direction pixels where the density of the toner image and its various regions (e.g., located before the control patch) that have just been printed that are less than the predetermined density threshold. In one embodiment, the control patch to be printed has a predetermined width that may be equal to a range of cross-process direction pixels. Therefore, in order to print a control patch, a range of cross-process direction pixels (e.g., equal to the width of the control patch) is to be determined where the density of the toner image is less than the predetermined density threshold. This is done by first determining a cross-process direction pixel where the density of the toner image is less than the predetermined density threshold. Then, a plurality of neighboring cross-process direction pixels for the current cross-process direction pixel is determined, where the plurality of neighboring cross-process direction pixels have the density of the toner image less than the predetermined density threshold.

Once such a range of cross-process pixels (i.e., a plurality of neighboring cross-process direction pixels) for which the density of the toner image is less than the predetermined density threshold is determined for the toner image that is located before the control patch, the same procedure (e.g., determining a single pixel with density of the toner image less than the predetermined threshold, and determining a range of neighboring pixels with density of the toner image less than the predetermined threshold) is repeated to determine a range of cross-process direction pixels for which the density of the toner image is less than the predetermined density threshold for the toner image that is located after the control patch. The comparison between the range of cross-process direction pixels before the inter-document zone (IDZ) and the range of cross-process direction pixels after the inter-document zone (IDZ) is done at procedure 1054.

Next, at procedure 1060, the location where the control patch will be printed is dynamically changed to a location in the cross-process direction if the range the cross-process pixels having density of the toner image is less than the predetermined density threshold located before the inter-document zone (IDZ) is equal to the range the cross-process pixels having density of the toner image is less than the predetermined density threshold located after the inter-document zone (IDZ). If not, in procedure 1056, a counter is incremented. In one embodiment, a counter is used by the controller of the method 1000. In one embodiment, the counter may have a predetermined threshold. In one embodiment, the predetermined threshold is two minutes or any other predetermined amount of time. In one embodiment, the predetermined threshold is number of prints, for example, 500 prints or any other predetermined amount of prints. At procedure 1058, the value of the counter is compared with the predetermined threshold of the counter, and if the value of the counter is greater than the predetermined threshold, the method 1000 proceeds to procedure 1062. At procedure 1062, the controller will skip one or more pitches before the inter-document zone, then print the control patch at procedure 1064, and then the controller will skip one or more pitches after the inter-document zone at procedure 1066 before resetting the counter at procedure 1068. The controller of the method 1000 will skip one or more "pitches," before printing the control patch so that no interaction between the toner image and control patch can occur.

Figure 1:
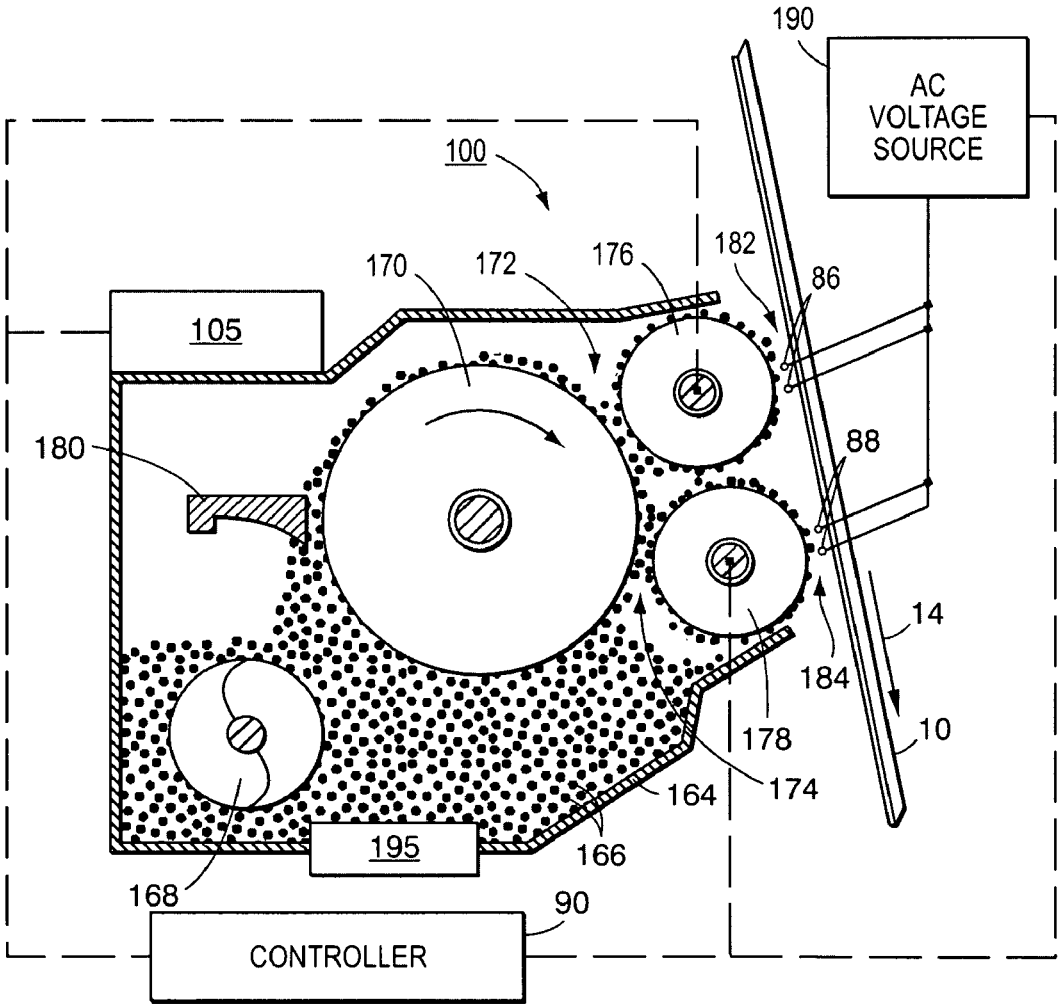
FIG. 1 (RELATED ART)
FIG. 1 illustrates a toner development system in an image printing system.
Figure 2:
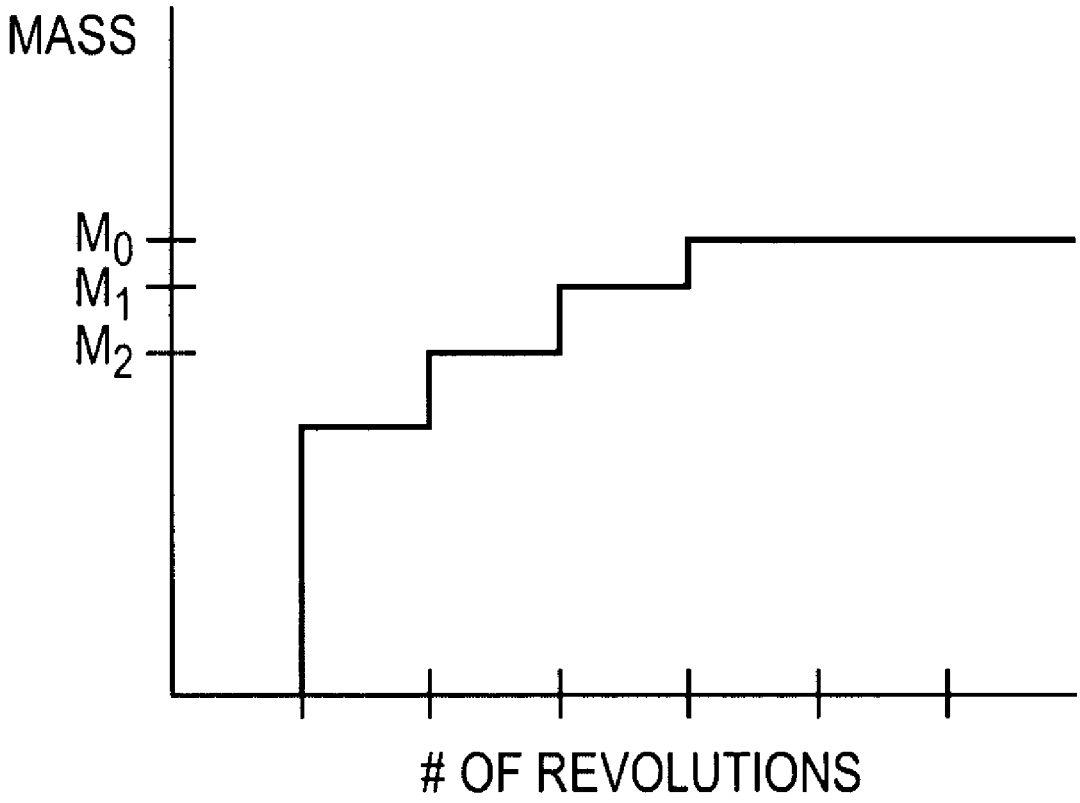
FIG. 2 illustrates a graph of the toner mass on a region of a donor roll in a toner development system after printing a control patch.

One pitch may be defined to be equal to one customer image zone on the image bearing surface (e.g., a photoreceptor belt). The number of skipped pitches may be selected, so as to make certain that the donor roll has rotated a sufficient number of times to replenish with toner (see FIG. 2). A single pitch may be sufficient to skip to reduce the impact of reload. In some implementations, a plurality of pitches may be skipped to further improve quality, although, this may lower productivity. In other implementations, the number of pitches to be skipped may be determined dynamically, for example, from the reload potential (sensitivity) of the input image data. The reload characteristics of the donor roll may be detectable through measurements of geometry of the process control patches, and measurements of the density of customer images before and after process control patches at the reload geometry. See, for example, U.S. Patent Application Publication No. 2006/0109487, mentioned above.

At procedure 1070, if further toner images are to be printed (i.e., the print job not completed), the method 1000 returns to procedure 1020. Otherwise, the method 1000 ends at procedure 1080.

In one embodiment, these predetermined density thresholds of the toner image (i.e., 20% for the toner image that is located after the control patch, and 55% for the toner image that is located before the control patch) apply to the image area within one donor revolution. In another embodiment, these predetermined density thresholds of the toner image (i.e., 20% for the toner image that is located after the control patch, and 55% for the toner image that is located before the control patch) apply to the image area as long as it is needed for the donor roll to acquire toner to fix the reload defect. In one embodiment, the predetermined density threshold is 55% on the top portion of the toner image and is 20% on the bottom portion of the same toner image.

In one embodiment, for example, when the density of the toner image is greater than 55% at the bottom portion of the toner image or when the density of the toner image is greater than 20% at the top portion of the toner image, then the control patch will not be printed at that time. In such embodiment, the controller may reschedule the printing of the control patch to the next available (or later) instance, or may skip printing the scheduled control patch so that no interaction between control patch and toner image can occur. In one embodiment, the skipped control patch may be rescheduled to a later instance for printing. Such a solution was disclosed, for example in U.S. patent application Ser. No. 12/176,736 filed Jul. 21, 2008, herein incorporated by reference in its entirety.

The controller disclosed herein may be dedicated hardware like ASICs or FPGAs, software, or a combination of dedicated hardware and software. For the different applications of the embodiments disclosed herein, the programming and/or configuration may vary. The controller may be incorporated, for example, into a print controller or marking engine controller of an image printing system.

The present disclosure enables reduced mottle performance while assuring robustness to reload interactions between customer to toner images and process control patches. In one embodiment, the embodiments of the present disclosure may similarly be applied to reload defects in magnetic brush development systems, which do not include donor rolls. Such systems are generally known, for example, as disclosed in U.S. Pat. No. 4,338,880, herein incorporated by reference in its entirety. In one embodiment, the present disclosure may be applied to low mottle development system designs that may inherently have greater reload challenges.

The terms "print," "printing," and/or "printed," as used herein may refer to printing on the output media of an image printing device, as well as, printing or otherwise marking on one or more intermediate transfer members of the printing device. The term "toner image" as used herein may refer to images of print jobs as opposed to images for control patches and/or other diagnostic targets.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What is claimed is:

1. A method for controlling an image printing system in the presence of reload defects, comprising:

placing toner images on an image bearing surface moving in a process direction;

determining the density of the toner image or a portion thereof being printed on the image bearing surface; and printing a scheduled control patch at a location in a cross-process direction on the image bearing surface, wherein the location where each control patch is printed is dynamically changed based on the density of the toner image adjacent the control patch or a portion thereof.

2. The method of claim 1, wherein the control patches are printed at the location where the density of the adjacent toner image is less than a predetermined density threshold.

3. The method of claim 2, wherein the predetermined density threshold of the toner image that is located before the control patch is approximately 55%.

4. The method of claim 2, wherein the predetermined density threshold of the toner image that is located after the control patch is approximately 20%.

5. The method of claim 1, wherein in determining the density of the toner image, the density of the toner image is measured using a sensor.

6. The method of claim 1, wherein in determining the density of the toner image, the density of the toner image is inferred from its input image content.

7. The method of claim 1, wherein the control patch is printed in an inter-document zone (IDZ) and the toner image is printed on an image zone on the image bearing surface.

8. The method of claim 7, wherein the control patch printed in the inter-document zone (IDZ) is detected using a linear array sensor extending in a cross-process direction and adjacent to the image bearing surface.

9. The method of claim 8, wherein the linear array sensor is a full width array (FWA) sensor.

10. The method of claim 1, wherein the image bearing surface is at least one of a photoreceptor drum, a photoreceptor belt, an intermediate transfer belt, an intermediate transfer drum, and other image bearing surfaces.

11. The method of claim 1, wherein the control patch is aligned with an area of the toner image where the density of the toner image is less than the predetermined density threshold so as to reduce the possibility of the toner image impacting the control patch or the control patch impacting the toner image when reload performance of a toner development system has degraded.

12. A system for controlling an image printing system in the presence of reload defects, comprising:

an image bearing surface moving in a process direction and is configured to receive toner images and control patches; and a controller configured to determine a location in a cross-process direction for printing a scheduled control patch on the image bearing surface, wherein the location where each control patch is printed is dynamically changed based on the density of the toner image adjacent the control patch or a portion thereof.

13. The system of claim 12, wherein the controller is configured to determine the location for each control patch where the density of the adjacent toner image is less than a predetermined density threshold.

14. The system of claim 13, wherein predetermined density threshold of the toner image that is located before the control patch is approximately 55%.

15. The system of claim 13, wherein the predetermined density threshold of the toner image that is located after the control patch is approximately 20%.

16. The system of claim 12, further comprising a sensor for determining the density of the toner image.

17. The system of claim 12, wherein, in determining the density of the toner image, the controller is configured to infer the density of the toner image from its input image content.

18. The system of claim 12, wherein a print engine is configured to print the control patch in an inter-document zone (IDZ) and the toner image in an image zone on the image bearing surface.

19. The system of claim 18, further comprising a linear array sensor extending in a cross-process direction and adjacent to the image bearing surface for sensing the control patch printed in the inter-document zone (IDZ).

20. The system of claim 19, wherein the linear array sensor is a full width array (FWA) sensor.

21. The system of claim 12, wherein the image bearing surface is at least one of a photoreceptor drum, a photoreceptor belt, an intermediate transfer belt, an intermediate transfer drum, and other image bearing surfaces.

22. The system of claim 12, wherein the controller is configured to determine the location of each control patch to align the control patch with an area of the toner image where the density of the toner image is less than the predetermined density threshold so as to reduce the possibility of the toner image impacting the control patch or the control patch impacting the toner image when reload performance of a toner development system has degraded.

* * * * *